US011108146B2

(12) United States Patent
Nguyen et al.

(10) Patent No.: US 11,108,146 B2
(45) Date of Patent: Aug. 31, 2021

(54) ANTENNA SHIELDS

(71) Applicant: HALLIBURTON ENERGY SERVICES, INC., Houston, TX (US)

(72) Inventors: Minh Dang Nguyen, Singapore (SG); Lay Wei Ang, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 16/004,288

(22) Filed: Jun. 8, 2018

(65) Prior Publication Data

US 2019/0379114 A1 Dec. 12, 2019

(51) Int. Cl.

| | |
|---|---|
| ***H01Q 7/00*** | (2006.01) |
| ***H01Q 1/40*** | (2006.01) |
| ***E21B 47/01*** | (2012.01) |
| ***H01Q 1/22*** | (2006.01) |

(52) U.S. Cl.

CPC ..... *H01Q 1/40* (2013.01); *E21B 47/01* (2013.01); *H01Q 1/22* (2013.01); *H01Q 7/00* (2013.01)

(58) Field of Classification Search

CPC ..... H01Q 21/0025; H01Q 1/40; H01Q 1/04; E21B 47/00; E21B 47/13; E21B 47/017

See application file for complete search history.

(56) References Cited

U.S. PATENT DOCUMENTS

| | | | | |
|---|---|---|---|---|
| 5,661,402 | A | 8/1997 | Chesnutt et al. | |
| 2004/0061622 | A1* | 4/2004 | Clark | G01V 3/28 340/854.6 |
| 2011/0074427 | A1 | 3/2011 | Wang et al. | |
| 2013/0255966 | A1 | 10/2013 | Palaghita et al. | |
| 2015/0061682 | A1 | 3/2015 | Homan et al. | |
| 2015/0075810 | A1* | 3/2015 | Wheater | E21B 17/206 166/378 |
| 2016/0369578 | A1* | 12/2016 | Korovin | E21B 47/017 |
| 2018/0142546 | A1 | 5/2018 | Zheng et al. | |

OTHER PUBLICATIONS

International Search Report for Application No. PCT/US2019/030461, dated Aug. 16, 2019.

* cited by examiner

*Primary Examiner* — Awat M Salih
(74) *Attorney, Agent, or Firm* — Benjamin Ford; C. Tumey Law Group PLLC

(57) ABSTRACT

A logging tool includes a tool mandrel, an antenna disposed on the tool mandrel and including one or more coil windings wrapped about the tool mandrel, an antenna shield disposed about the antenna and including at least two pieces, and a constraining element to limit rotational motion of the antenna shield about the tool mandrel. The constraining element is disposed in a through hole defined in the antenna shield and a cavity defined in the tool mandrel, and the antenna shield and the tool mandrel are coupled to each other via an interference fit between the constraining element and the through hole and the cavity.

10 Claims, 8 Drawing Sheets

ANTENNA SHIELDS

FIELD

This disclosure relates, in general, to antenna shields used in electromagnetic logging tools and, in particular, to removable antenna shields for protecting the antennas used in the electromagnetic logging tools used in a subterranean well logging system.

BACKGROUND

During drilling operations for the extraction of hydrocarbons, a variety of recording and transmission techniques are used to provide or record real-time data from the vicinity of a drill bit. Measurements of surrounding subterranean formations may be made throughout drilling operations using downhole measurement and logging tools, such as measurement-while-drilling (MWD) tools, which aid in making operational decisions, and logging-while-drilling (LWD) tools, which help characterize the formations. LWD tools in particular obtain measurements of the subterranean formations being penetrated for determining the electrical resistivity (or its inverse, conductivity) of the subterranean formations, where the electrical resistivity indicates various geological features of the formations. These resistivity measurements may be taken using one or more antennas coupled to or otherwise associated with the wellbore logging tools. The measurements may be processed downhole or the measurements may be transmitted to a surface location for processing.

Logging tool antennas are often formed by positioning coil windings about an axial section of the wellbore logging tool, such as a drill collar. The wellbore logging tools are subject to severe mechanical impacts with the borehole wall and with cuttings in the borehole fluid. These impacts damage the sensitive antennas (and other components of the tool) if unprotected. Antenna shields are commonly used to physically protect the antennas.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The present disclosure relates generally to antenna shields for wellbore logging tools used in the oil and gas industry and, more particularly, to removable antenna shields that are made of two or more discrete component parts and that may be disassembled from the wellbore logging tool for repair and/or service. The antenna shield may be disassembled without damaging the antenna shield and the wellbore logging tool. After repair and/or service, the antenna shield parts may be reassembled on the wellbore logging tool. It may thus be possible to reuse the antenna shield. The antenna shields used in resistivity logging tools protect the antennas of the resistivity logging tools used for monitoring surrounding subterranean formations adjacent a drilled wellbore. Additionally, the antenna shield, according to embodiments disclosed, may be coupled to the tool mandrel using fasteners and constraining elements. The constraining elements may be coupled to the tool mandrel via an interference fit and may limit rotational motion of the antenna shield about the tool mandrel. By minimizing the rotational motion, damage to the fasteners may be limited.

An antenna shield, according to one or more embodiments, may comprise multiple component parts coupled together that can be assembled and disassembled in the field. The repair and maintenance of the antennas can be performed with relative ease and in shorter time duration in the field. This improves asset utilization by reducing downtime since it may not be required to ship the wellbore logging tool to specialized service centers. If a component part is damaged and needs to be replaced, only the damaged component part may be replaced and not the whole antenna shield. Further, by providing an antenna shield that can be dismantled and reassembled, it is possible to reuse the antenna shield and further reduce repair costs.

Figure 1:
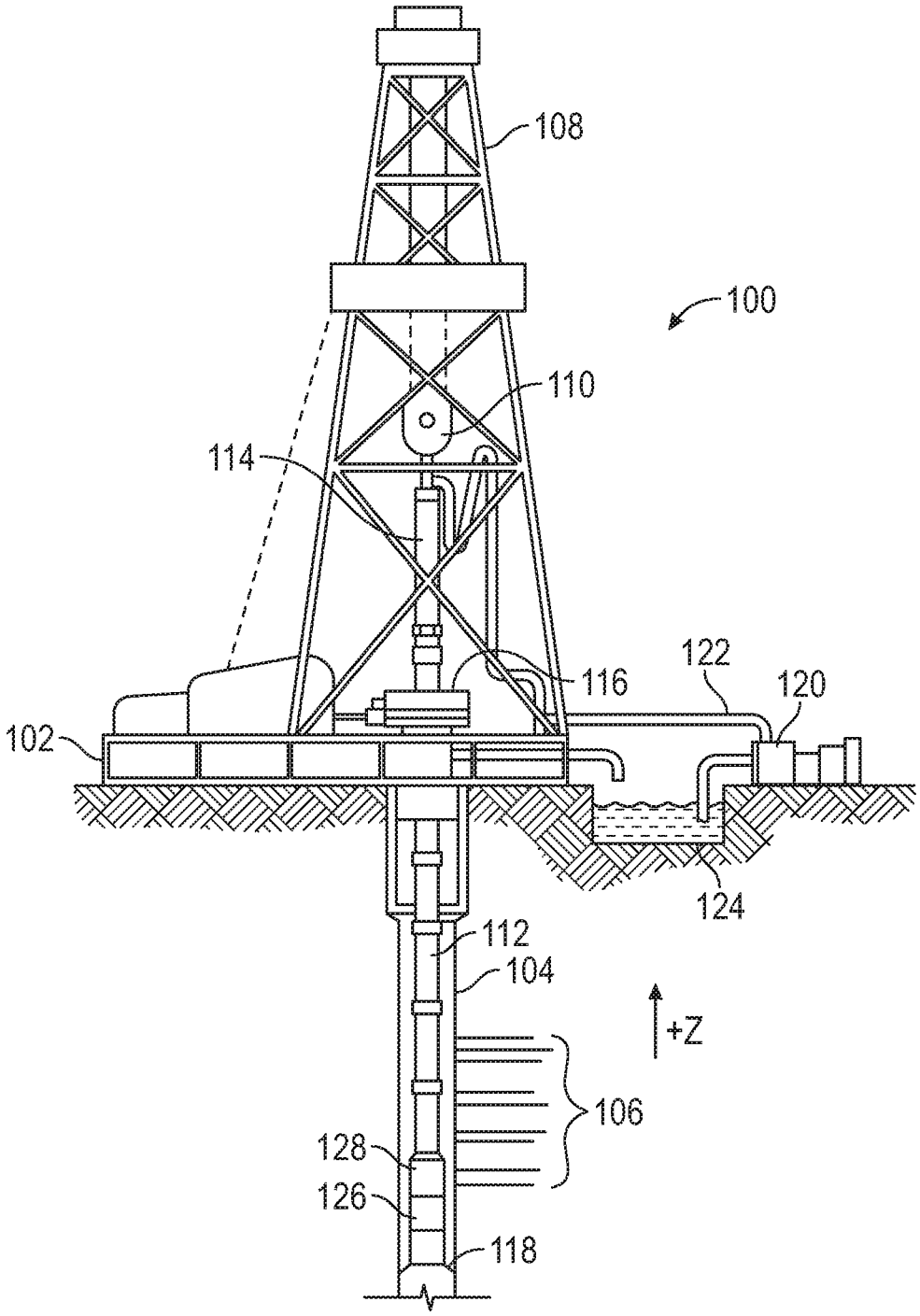
FIG. 1 is a schematic diagram of an example drilling system that may employ the principles of the present disclosure.

FIG. 1 is an elevation view of an example drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106.

The drilling system 100 may include a derrick 108 supported by the drilling platform 102 and having a traveling block 110 for raising and lowering a drill string 112. A kelly 114 may support the drill string 112 as it is lowered through a rotary table 116. A drill bit 118 may be coupled to the drill string 112 and driven by a downhole motor and/or by rotation of the drill string 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of drill string 112, through orifices in the drill bit 118, back to the surface via the annulus defined around drill string 112, and into a retention pit 124. The drilling fluid cools the drill bit 118 during operation and transports cuttings from the wellbore 104 into the retention pit 124.

The drilling system 100 may further include a bottom hole assembly (BHA) coupled to the drill string 112 near the drill bit 118. The BHA may comprise various downhole measurement tools such as, but not limited to, measurement-while-drilling (MWD) and logging-while-drilling (LWD) tools, which may be configured to take downhole measurements of drilling conditions. The MWD and LWD tools may include at least one resistivity logging tool 126, which may comprise an antenna shield, according to embodiments disclosed, for protecting the antennas of the resistivity logging tool 126.

As the drill bit 118 extends the wellbore 104 through the formations 106, the resistivity logging tool 126 may continuously or intermittently collect azimuthally-sensitive measurements relating to the resistivity of the formations 106, i.e., how strongly the formations 106 opposes a flow of electric current. The resistivity logging tool 126 and other sensors of the MWD and LWD tools may be communicably coupled to a telemetry module 128 used to transfer measurements and signals from the BHA to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the resistivity logging tool 126 may also be stored within the resistivity logging tool 126 or the telemetry module 128 for later retrieval at the surface upon retracting the drill string 112.

Figure 2:
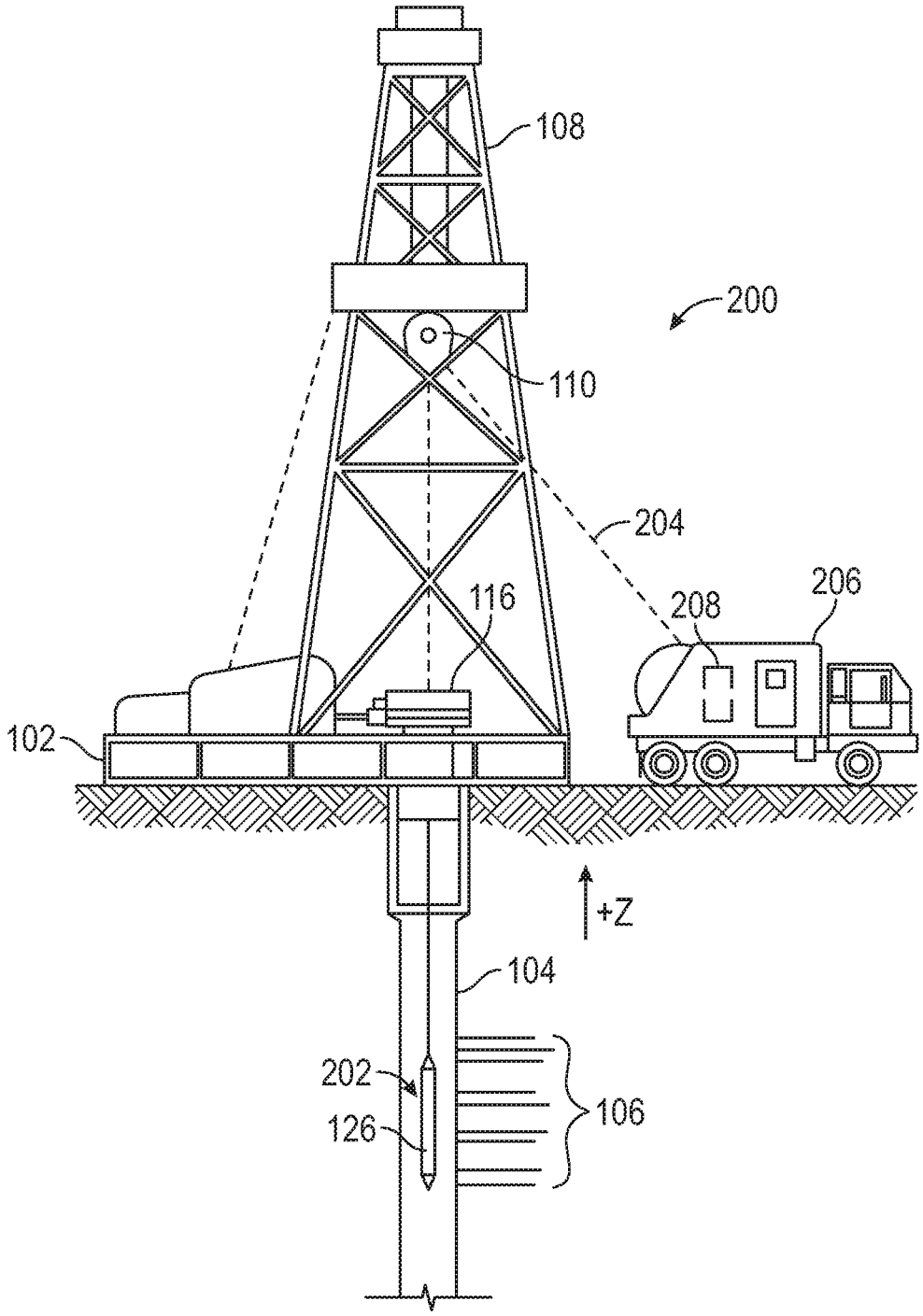
FIG. 2 is a schematic diagram of an example wireline system that may employ the principles of the present disclosure.

At various times during the drilling process, the drill string 112 may be removed from the wellbore 104, as shown in FIG. 2, to conduct measurement/logging operations. More particularly, FIG. 2 is an elevation view of an example wireline system 200 that may employ the principles of the present disclosure, according to one or more embodiments. Like numerals used in FIGS. 1 and 2 refer to the same components or elements and, therefore, may not be described again in detail. As illustrated, the wireline system 200 may include a wireline instrument sonde 202 that may be suspended in the wellbore 104 on a cable 204. The sonde 202 may include the resistivity logging tool 126 described above, which may be communicably coupled to the cable 204. The cable 204 may include conductors for transporting power to the sonde 202 and also facilitate communication between the surface and the sonde 202. A logging facility 206, shown in FIG. 2 as a truck, may collect measurements from the resistivity logging tool 126, and may include computing and data acquisition systems 208 for controlling, processing, storing, and/or visualizing the measurements gathered by the resistivity logging tool 126. The computing and data acquisition systems 208 may be communicably coupled to the resistivity logging tool 126 by way of the cable 204.

Even though FIGS. 1 and 2 depict the systems 100 and 200 including vertical wellbores, it should be understood by those skilled in the art that principles of the present disclosure are equally well suited for use in wellbores having other orientations including horizontal wellbores, deviated wellbores, slanted wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIGS. 1 and 2 depict an onshore operation, it should be understood by those skilled in the art that principles of the present disclosure are equally well suited for use in offshore operations, wherein a volume of water may separate the drilling platform 102 and the wellbore 104.

Figure 3:
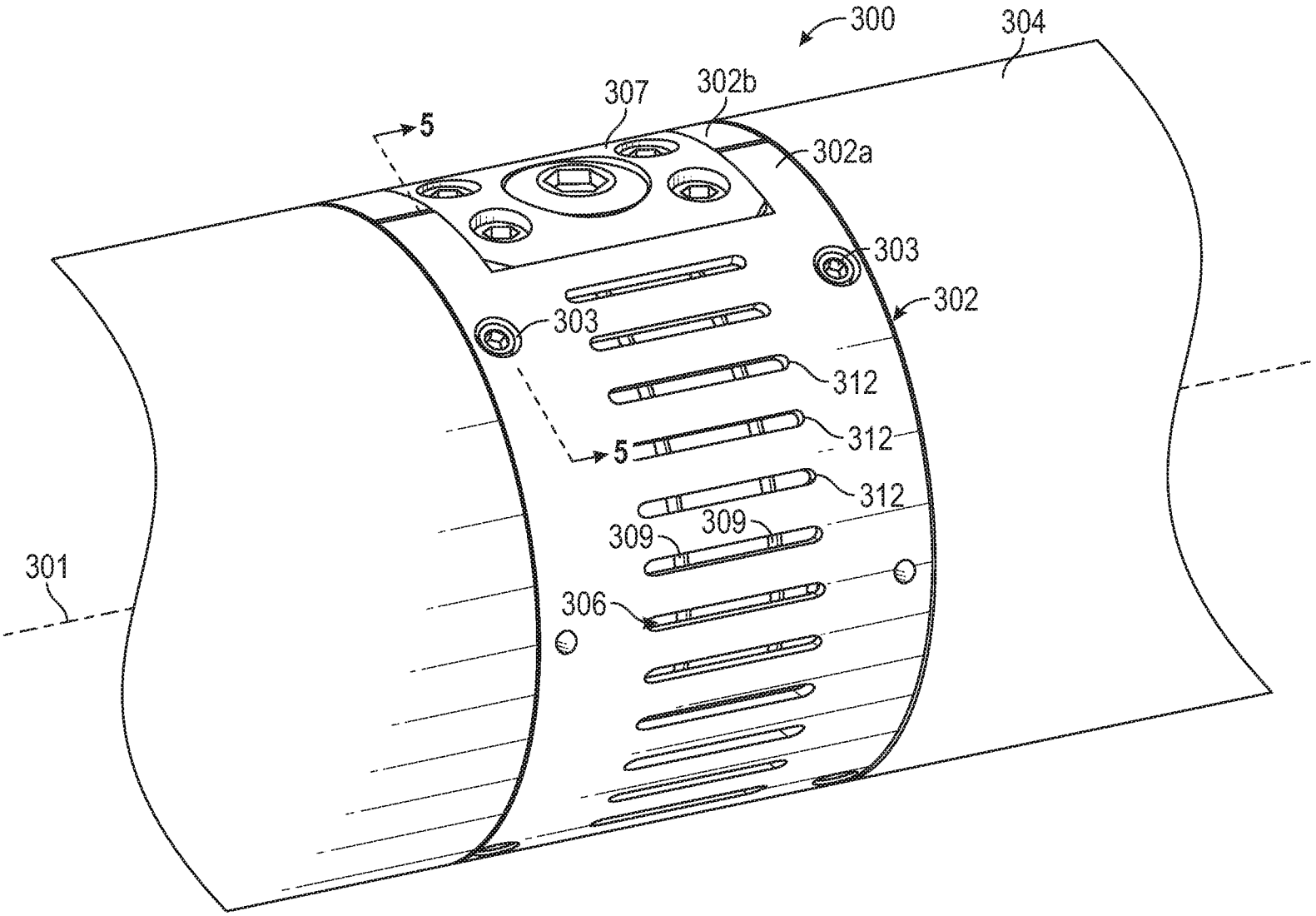
FIG. 3 illustrates a partial isometric view of an example wellbore logging tool, according to embodiments disclosed.

FIG. 3 is a partial isometric view of an example wellbore logging tool 300, according to embodiments disclosed. The logging tool 300 may be the same as or similar to the resistivity logging tool 126 of FIGS. 1 and 2 and, therefore, may be used in the drilling or wireline systems 100, 200 depicted therein. The wellbore logging tool 300 is depicted as including an antenna shield 302 that can be positioned about a tool mandrel 304, such as a drill collar or the like. The antenna shield 302 is positioned on an antenna 306 of the wellbore logging tool 300. The antenna 306 is formed by positioning coil windings 309 about the tool mandrel 304 and is capable of receiving and/or transmitting one or more electromagnetic (EM) signals. Although FIG. 3 illustrates a single antenna 306 formed from two coil windings 309, the number of antennas 306 and the number of coil windings 309 forming each antenna 306 is not limited in this regard. Further, the antenna shield 302 may be used with a variety of antenna configurations including, but not limited transverse antennas, a bi-planar antennas, tiled coil antennas, saddle coil antennas, a combination thereof, and the like.

Figure 5:
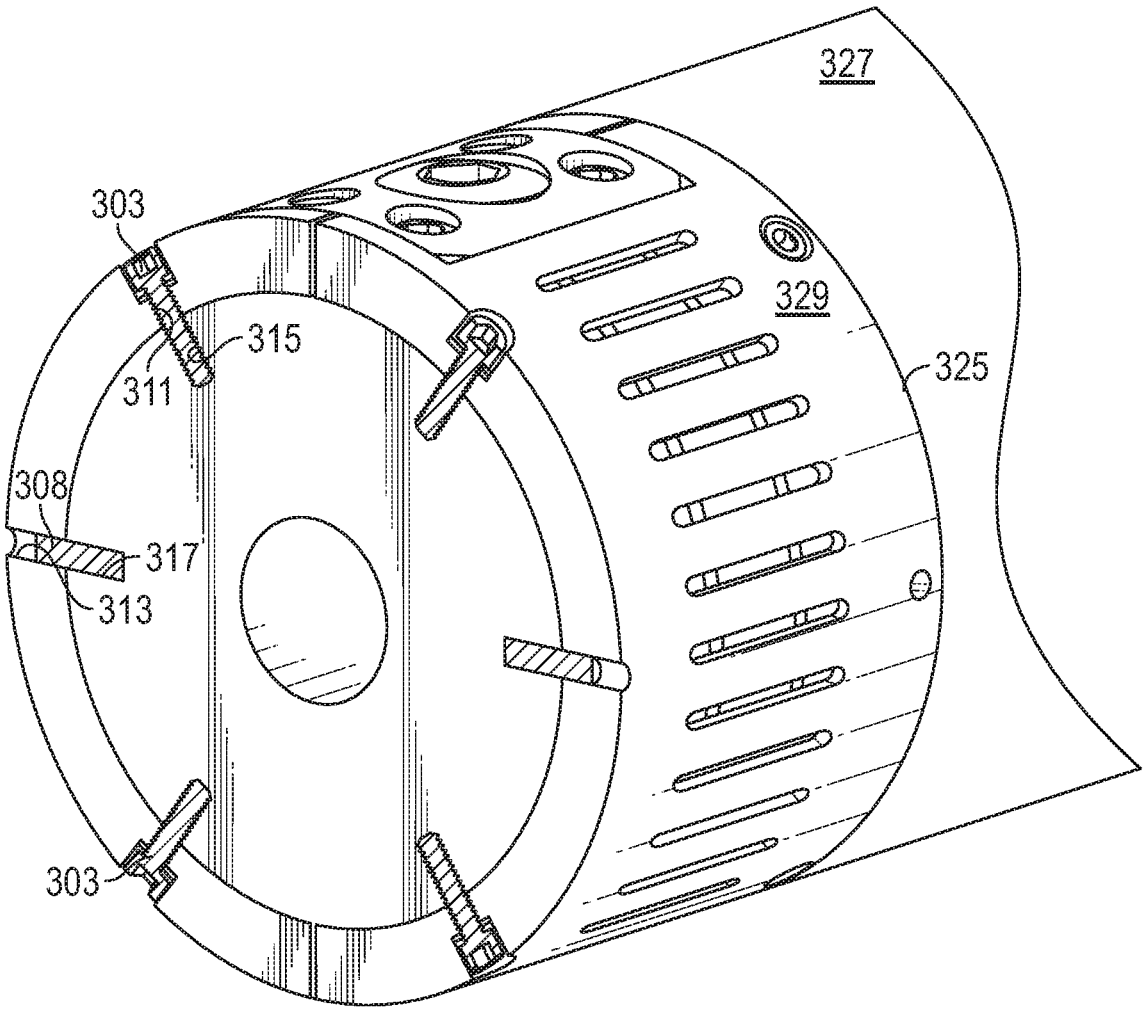
FIG. 5 illustrates a cross-sectional view of the wellbore logging tool of FIG. 3, according to examples disclosed.

The antenna shield 302 may be made of two or more (two shown in FIG. 3) pieces 302*a* and 302*b* that are removably coupled to the tool mandrel 304 using fasteners 303. In an example, the fasteners 303 may include fasteners such as screws, bolts, rivets, clips, etc. that may be removed without damaging the antenna shield 302 and the tool 300. Thus, the pieces 302*a* and 302*b* can be separated from the tool 300 (or more specifically, from the mandrel 304) for repair and service, and reused. The antenna shield 302 may include a plurality of circumferentially spaced axially elongated slots 312. Each slot 312 may be a through-hole in the antenna shield 302 through which the antennas 306 may transmit and/or receive electromagnetic (EM) signals. By elongated, it is meant that the length of the slot 312 is substantially parallel with a longitudinal axis 301 of the tool 300. Although the slots 312 are depicted as elongated slots, the shape of the slots 312 is not limited in this regard. The slots 312 may be oriented at substantially any angle with respect to the axis 301, without departing from the scope of the disclosure. Further, although the slots 312 are depicted as being located in the central portion of the antenna shield, the location of the slots 312 is also not limited in this regard. In addition to the fasteners 303, the antenna shield 302 may be coupled to the mandrel 304 using a plurality of constraining elements 308 (FIG. 5). In the absence of constraining elements 308, the antenna shield 302 may rotate about the mandrel 304. The constraining elements 308 limit the rotational motion of the antenna shield 302 about the mandrel 304 and minimize damage to the fasteners 303.

Figure 4:
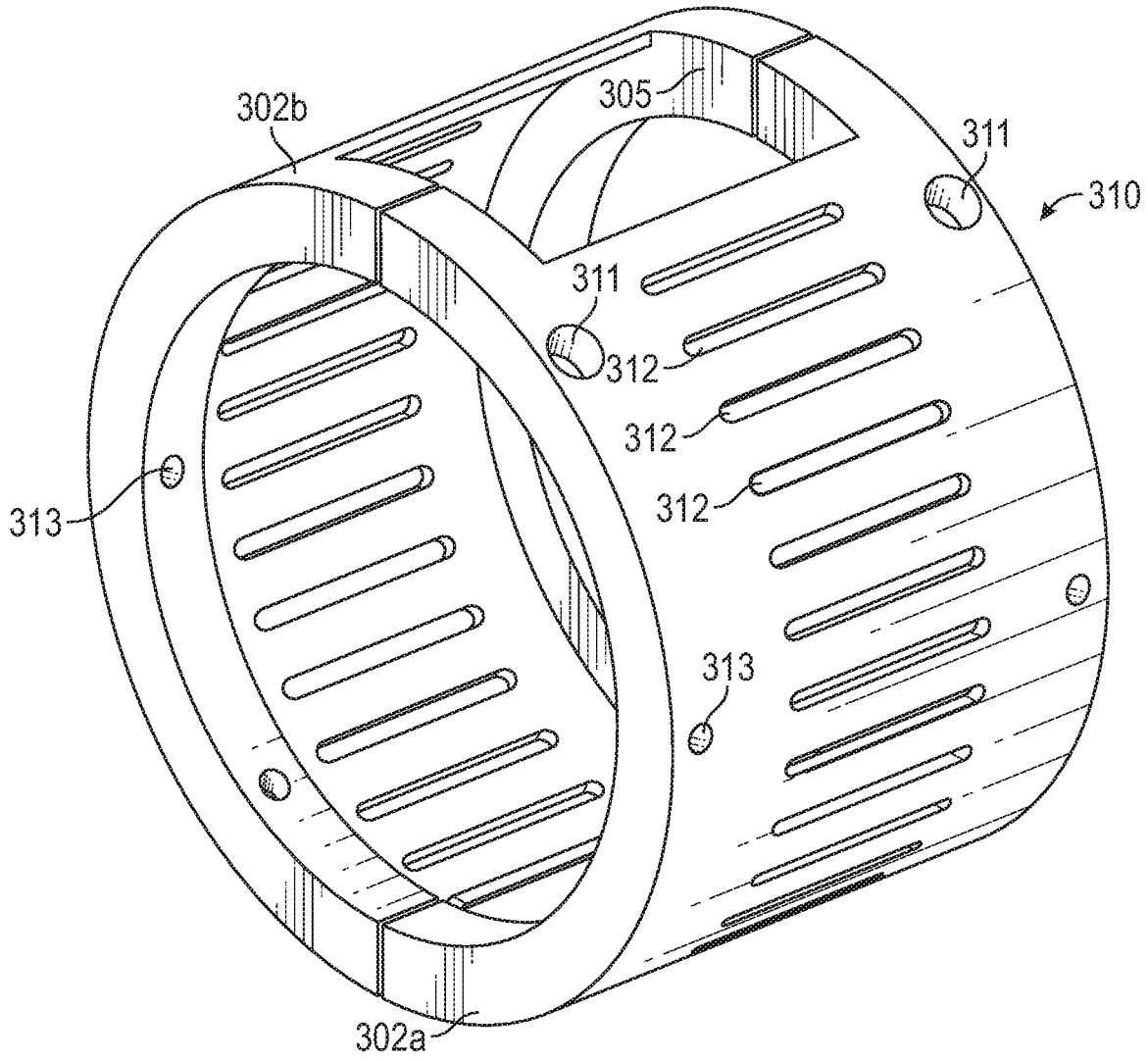
FIG. 4 illustrates an isometric view of the antenna shield of the wellbore logging tool of FIG. 3, according to embodiments disclosed.

FIG. 4 illustrates an isometric view of the antenna shield 302, according to embodiments disclosed. As illustrated, the antenna shield 302 has a generally cylindrical body 310 formed by two semi-cylindrical pieces 302*a* and 302*b*. The pieces 302*a* and 302*b* cooperatively define an opening 305 for receiving a housing 307 (FIG. 3) that may include circuitry for controlling an operation of the antennas 306. For instance, the circuitry may control an operation of the antennas 306 to transmit and receive EM signal to and from the subterranean formations 106 (FIG. 1). A first set of through holes 311 may be defined in the body 310 along the peripheral edges thereof. In an example, and as illustrated, the first set of through holes 311 may be located at regular intervals along the body 310 and may be sized or otherwise configured to receive the fasteners 303. However, it should be noted that the location and number of through holes 311 is not limited in this regard, and may be varied as required by application and/or design, without departing from the scope of the disclosure. Additionally, as illustrated, the body 310 may include a second set of through holes 313 that are sized or otherwise configured to receive the constraining elements 308. In an example, and as illustrated, the second set of through holes 313 may be located at regular intervals along the body 310. However, the location and number of the through holes 313 is not limited in this regard, and may be varied as required by application and/or design, without departing from the scope of the disclosure.

FIG. 5 illustrates a cross-sectional view of the wellbore logging tool 300 taken along 5-5 in FIG. 3, according to examples disclosed. The antenna shield 302 may be disposed in a recess 325 defined in the mandrel 304. The recess 325 may be sized and shaped, or otherwise configured, such that the outer circumferential surface 327 of the mandrel 304 is flush with the outer circumferential surface 329 of the antenna shield 302 when the antenna shield 302 is disposed in the recess 325. The fasteners 303 may be received via the first set of through holes 311 into corresponding cavities (or blind holes) 315 defined in the mandrel 304. The fasteners 303 may provide the clamping force for coupling the antenna shield 302 to the mandrel 304. Typically, a small clearance may be defined between the fasteners 303 and the inner walls of the corresponding cavities 315. Because of the clearance, the antenna shield 302 may be free to rotate about the mandrel 304. The external dimension of the constraining elements 308 slightly exceeds the internal dimension of the second set of through holes 313 and the corresponding cavities 317. In an example, the constraining elements 308 may be dowel pins. However, the constraining elements 308 are not limited in this regard. The diameter of the dowel pins may be slightly bigger than the inner diameter of the second set of through holes 313 and the cavities 317. Thus, the antenna shield 302 and the mandrel 304 are coupled to each other via an interference fit (also referred to as a press fit or friction fit) between the constraining elements (dowel pins) 308 and the second set of through holes 313 and the corresponding cavities 317.

As mentioned above, the wellbore logging tool 300 is subjected to mechanical impacts in the wellbore. In the absence of the dowel pins 308, any torque exerted on the antenna shield 302 may impart a rotational motion to the antenna shield 302 about the mandrel 304. The rotational motion may cause the fasteners 303 to break and the antenna shield 302 to come apart. However, because of the interference fit between the dowel pins 308 and the second set of through holes 313 and the corresponding cavities 317, the torque exerted on the antenna shield 302 is first transferred to the dowel pins 308. However, because of the constraining elements 308, the antenna shield 302 is limited from rotating about the mandrel 304. When the torque exceeds a predetermined threshold value, the dowel pins 308 break before the fasteners 303. The dowel pins 308 thus act as sacrificial components by limiting damage to the fasteners 303. This arrangement thus may avoid the antenna shield 302 from coming apart in the wellbore and damage to the antennas 306 is limited.

Figure 6:
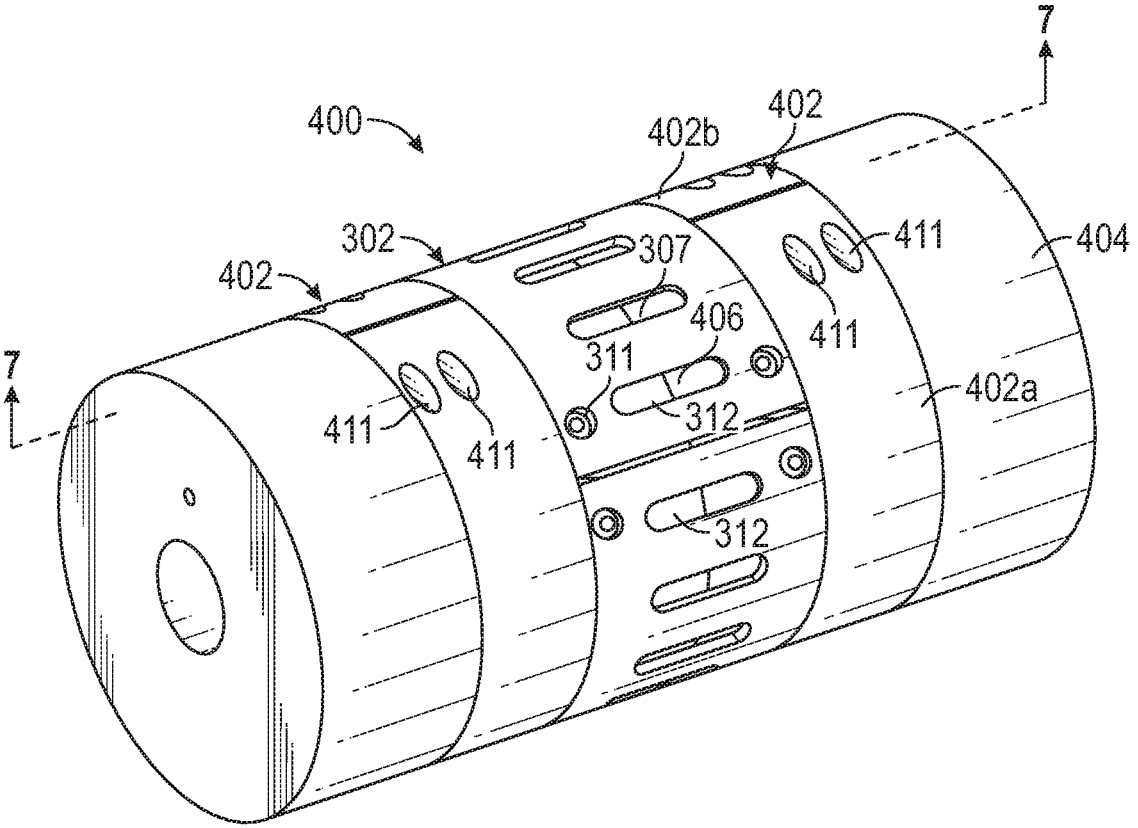
FIG. 6 is a partial isometric view of another wellbore logging tool, according to embodiments disclosed.

FIG. 6 is a partial isometric view of a wellbore logging tool 400, according to embodiments disclosed. The wellbore logging tool 400 may be similar in some respects to the wellbore logging tool 300 in FIGS. 3-5, and therefore may be best understood with reference thereto where like numerals designate like components not described again in detail. As illustrated, the wellbore logging tool 400 may include two locking rings 402, each disposed on a tool mandrel 404 (a drill collar or the like) at axially opposite ends of the antenna shield 302. Each locking ring 402 may be formed from two or more (two shown in FIG. 6) pieces 402*a* and 402*b*. The pieces 402*a* and 402*b* are removably coupled to each other via removable fasteners (screws, bolts, rivets, clips, etc.) received in through holes 411 defined in the pieces 402*a* and 402*b*. The fasteners coupling the pieces 402*a* and 402*b* may be removed without damaging the pieces 402*a* and 402*b*, the antenna shield 302, and the tool 300. The antenna shield 302 may be positioned over an antenna 406 depicted as a single coil wound about the mandrel 404. However, in other embodiments, the antenna 406 may include a plurality of coils, without departing from the scope of the disclosure.

Figure 7:
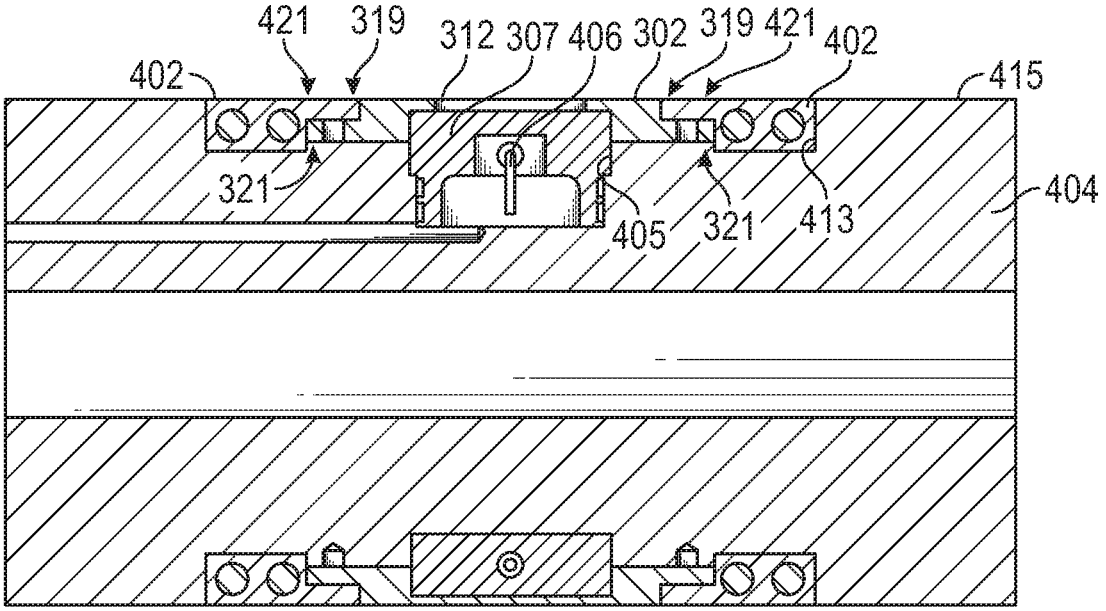
FIG. 7 illustrates a cross-sectional view of the wellbore logging tool of FIG. 6, according to embodiments disclosed.

FIG. 7 illustrates a cross-sectional view of the wellbore logging tool 400 taken along 7-7 in FIG. 6, according to embodiments disclosed. As illustrated, the antenna shield 302 and the locking rings 402 are received in a recess (or a concavity) 413 defined on the outer circumferential surface 415 of the mandrel 404 and that is sized and shaped such that the outer circumferential surfaces 417 and 419 of the antenna shield 302 and the locking rings 402, respectively, are flush with the outer circumferential surface 415 of the mandrel 404. Each axial end 319 of the antenna shield 302 defines a stepped profile 321 that mates with a corresponding stepped profile 421 of the adjacent locking rings 402. In an example, and as illustrated, the stepped profiles 321 and 421 are complementary to each other such that the locking ring 402 overlaps the antenna shield 302. Also illustrated is the housing 307 that may include circuitry for controlling an operation of the antenna 306. In an example and as illustrated, the housing 307 may be received in a recess (or a concavity) 405 defined in the mandrel 404, and the antenna shield 302 may be positioned over the housing 307.

Figure 8:
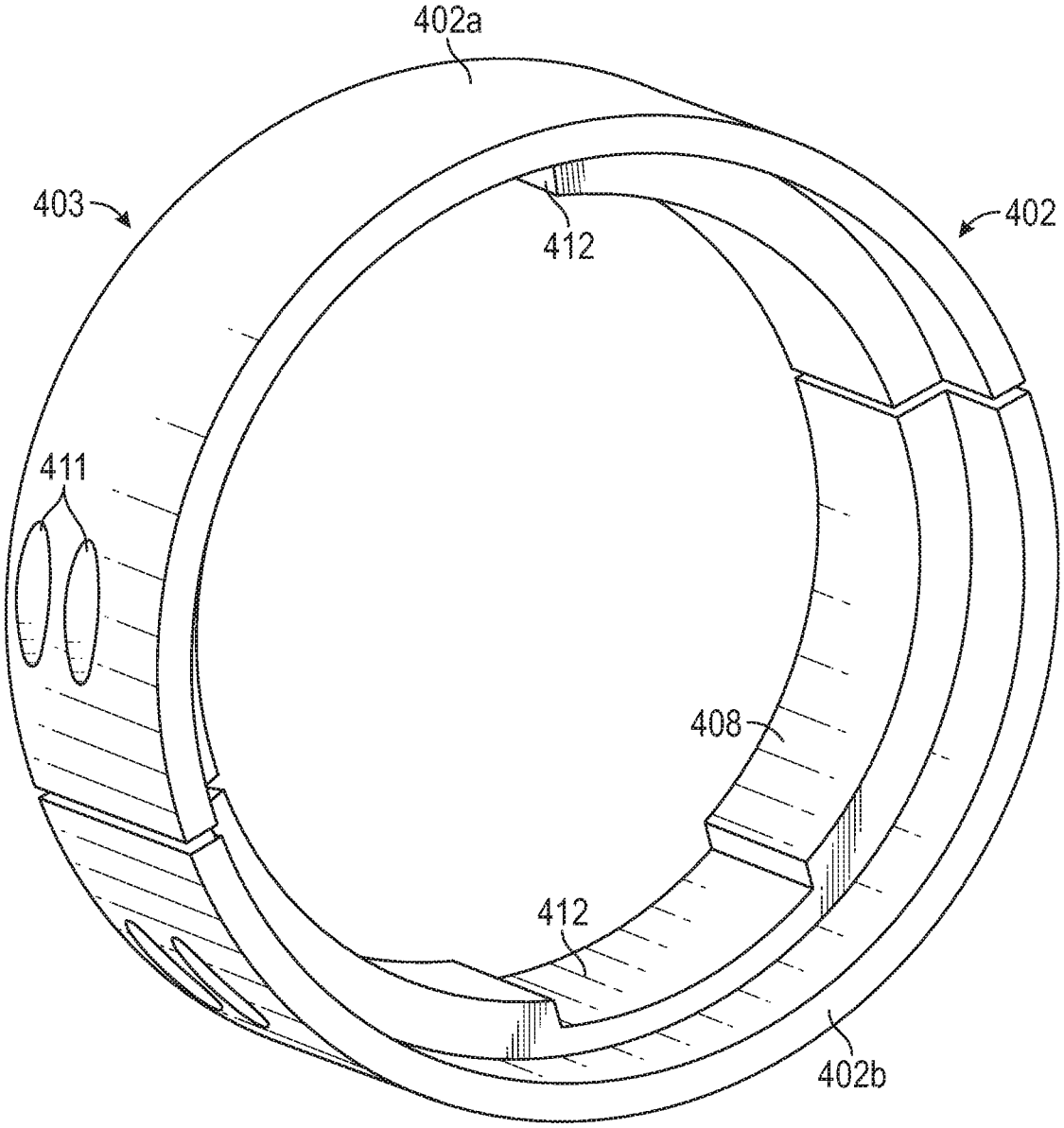
FIG. 8 is an isometric view of the locking ring of the wellbore logging tool of FIG. 6, according to embodiments disclosed.

FIG. 8 is an isometric view of the locking ring 402, according to embodiments disclosed. As illustrated, the locking ring 402 includes a cylindrical body 403 formed from semi-cylindrical pieces 402*a* and 402*b*. In an example, and as illustrated, the pieces 402*a* and 402*b* may be removably coupled to each other via fasteners received in the through holes 411. Each piece 402*a* and 402*b* defines one or more (one shown) recesses 412 in the inner circumferential surface 408 thereof.

Figure 9:
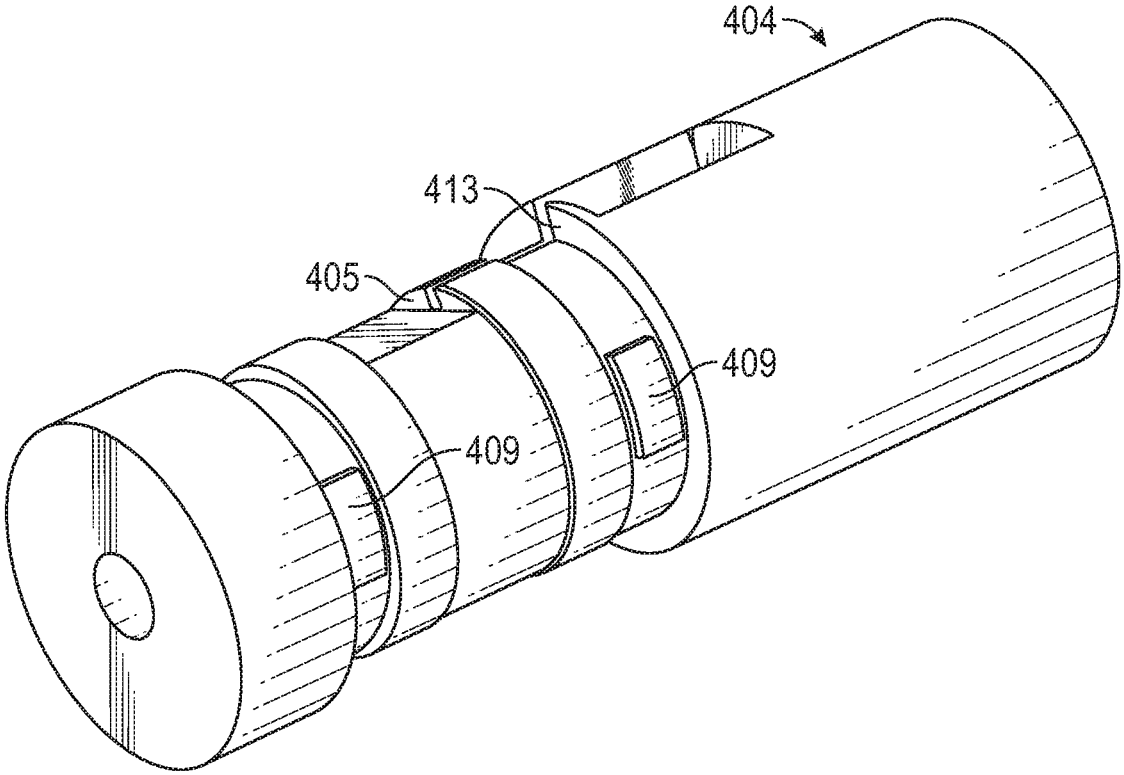
FIG. 9 is an isometric view of the mandrel of the wellbore logging tool of FIG. 6, according to embodiments disclosed.

FIG. 9 is an isometric view of the mandrel 404 of the wellbore logging tool 400, according to embodiments disclosed. For the sake of illustration, the antenna shield 302 and locking rings 402 are omitted in FIG. 9. Referring to FIG. 9 (with continued reference to FIG. 6), the mandrel 404 defines projections 409 each corresponding to a recess 412. An external dimension of each projection 409 is slightly bigger than the internal dimensions of the corresponding recess 412. Thus, an interference fit is created between the locking ring 402 and the mandrel 404 when the locking ring 402 is disposed on the mandrel 404. The locking rings 402 retain the antenna shield 302 on the mandrel 404 in case the fasteners 303 break. The locking rings 402 minimize movement of the antenna shield 302 and force acting on a locking ring 402 is transferred to the mandrel 404 because of the interference fit between the locking ring 402 and the mandrel 404. Thus, in addition to the dowel pins, the locking rings 402 also limit damage to the fasteners in the holes 411.

Embodiments disclosed herein include:

Embodiment A

A logging tool, comprising: a tool mandrel; an antenna disposed on the tool mandrel and including one or more coil windings wrapped about the tool mandrel; an antenna shield disposed about the antenna, the antenna shield including at least two pieces; and a constraining element to limit rotational motion of the antenna shield about the tool mandrel, the constraining element disposed in a through hole defined in the antenna shield and a cavity defined in the tool mandrel, and the antenna shield and the tool mandrel being coupled to each other via an interference fit between the constraining element and the through hole and the cavity.

Embodiment B

A logging tool, comprising: a tool mandrel; an antenna disposed on the tool mandrel and including one or more coil windings wrapped about the tool mandrel; an antenna shield disposed about the antenna, the antenna shield including at least two pieces; and a first locking ring disposed on the tool mandrel and on the antenna shield for coupling the antenna shield to the tool mandrel, the first locking ring including at least two pieces removably coupled to each other.

Embodiment C

A method, comprising: introducing a logging tool into a wellbore, the logging tool including: a tool mandrel; an antenna disposed on the tool mandrel and including one or more coil windings wrapped about the tool mandrel; an antenna shield about the antenna, the antenna shield including at least two pieces; and a constraining element to limit rotational motion of the antenna shield about the tool mandrel, the constraining element disposed in a through hole defined in the antenna shield and a cavity defined in the tool mandrel, and the antenna shield and the tool mandrel being coupled to each other via an interference fit between the constraining element and the through hole and the cavity; and obtaining measurements of a surrounding subterranean formation with the logging tool.

Embodiment D

A method, comprising: introducing a logging tool into a wellbore, the logging tool including: a tool mandrel; an antenna disposed on the tool mandrel and including one or more coil windings wrapped about the tool mandrel; an antenna shield disposed about the antenna, the antenna shield including at least two pieces; and a first locking ring disposed on the tool mandrel and on the antenna shield for coupling the antenna shield to the tool mandrel, the first locking ring including at least two pieces removably coupled to each other; and obtaining measurements of a surrounding subterranean formation with the logging tool.

Each of embodiments A, B, C, and D may have one or more of the following additional elements in any combination. Element 1: a fastener for removably coupling the antenna shield to the tool mandrel. Element 2: wherein the constraining element includes a dowel pin. Element 3: a plurality of circumferentially spaced and axially elongated slots defined in the antenna shield, wherein the antenna is exposed through the slots. Element 4: wherein the slots are substantially parallel with a longitudinal axis of the logging tool. Element 5: wherein the antenna shield is disposed in a recess defined in the tool mandrel, and wherein an outer circumferential surface of the antenna shield is flush with an outer circumferential surface of the tool mandrel.

Element 6: a constraining element to limit rotational motion of the antenna shield about the tool mandrel, the constraining element disposed in a through hole defined in the antenna shield and a cavity defined in the tool mandrel, and the antenna shield and the tool mandrel being coupled to each other via an interference fit between the constraining element and the through hole and the cavity. Element 7: wherein the tool mandrel includes a projection extending radially outward from the tool mandrel and the first locking ring includes a recess configured to receive the projection therein, and wherein the first locking ring and the tool mandrel are coupled to each other via an interference fit between the projection and the recess. Element 8: wherein the antenna shield and the first locking ring are disposed in a recess defined in the tool mandrel, and wherein outer circumferential surfaces of the antenna shield, the first locking ring, and the tool mandrel are flush with each other. Element 9: a fastener for removably coupling the antenna shield to the tool mandrel. Element 10: a fastener for removably coupling the at least two pieces of the first locking ring to each other. Element 11: a second locking ring disposed on the tool mandrel and on the antenna shield for coupling the antenna shield to the tool mandrel, wherein the first and second locking rings are disposed at an axially opposite ends of the antenna shield. Element 12: a plurality of circumferentially spaced and axially elongated slots defined in the antenna shield, wherein the antenna is exposed through the slots. Element 13: wherein the slots are substantially parallel with a longitudinal axis of the logging tool.

Element 14: wherein the tool mandrel is operatively coupled to a drill string and introducing the logging tool into the wellbore further comprises: extending the logging tool into the wellbore on the drill string; and drilling a portion of the wellbore with a drill bit secured to a distal end of the drill string. Element 15: wherein introducing the logging tool into the wellbore further comprises extending the logging tool into the wellbore on wireline as part of a wireline instrument sonde. Element 16: wherein the constraining element includes a dowel pin. Element 17: wherein the logging tool further includes a fastener for removably coupling the antenna shield to the tool mandrel. Element 18: wherein the logging tool further includes a plurality of circumferentially spaced and axially elongated slots defined in the antenna shield, wherein the slots are substantially parallel with a longitudinal axis of the logging tool and the antenna is exposed through the slots.

Element 19: wherein the tool mandrel is operatively coupled to a drill string and introducing the logging tool into the wellbore further comprises: extending the logging tool into the wellbore on the drill string; and drilling a portion of the wellbore with a drill bit secured to a distal end of the drill string. Element 20: wherein introducing the logging tool into the wellbore further comprises extending the logging tool into the wellbore on wireline as part of a wireline instrument sonde. Element 21: wherein the logging tool further includes a plurality of circumferentially spaced and axially elongated slots defined in the antenna shield, wherein the slots are substantially parallel with a longitudinal axis of the logging tool and the antenna is exposed through the slots. Element 22: wherein the tool mandrel includes a projection extending radially outward from the tool mandrel and the first locking ring includes a recess configured to receive the projection therein, and wherein the first locking ring and the tool mandrel are coupled to each other via an interference fit between the projection and the recess. Element 23: wherein the logging tool further includes a second locking ring disposed on the tool mandrel and on the antenna shield for coupling the antenna shield to the tool mandrel, wherein the first and second locking rings are disposed at an axially opposite ends of the antenna shield.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A logging tool, comprising:

a tool mandrel;

an antenna disposed on the tool mandrel and including one or more coil windings wrapped about the tool mandrel;

an antenna shield disposed about the antenna, the antenna shield including at least two pieces;

a fastener for removably coupling the antenna shield to the tool mandrel; and a constraining element to limit rotational motion of the antenna shield about the tool mandrel to limit torsional forces on the fastener, the constraining element disposed in a through hole defined in the antenna shield and a cavity defined in the tool mandrel, and the antenna shield and the tool mandrel being coupled to each other via an interference fit between the constraining element and the through hole and the cavity.

2. The logging tool of claim 1, wherein the constraining element includes a dowel pin.

3. The logging tool of claim 1, further comprising:

a plurality of circumferentially spaced and axially elongated slots defined in the antenna shield, wherein the antenna is exposed through the slots.

4. The logging tool of claim 3, wherein the slots are substantially parallel with a longitudinal axis of the logging tool.

5. The logging tool of claim 1, wherein the antenna shield is disposed in a recess defined in the tool mandrel, and wherein an outer circumferential surface of the antenna shield is flush with an outer circumferential surface of the tool mandrel.

6. A method, comprising:

introducing a logging tool into a wellbore, the logging tool including:

a tool mandrel;

an antenna disposed on the tool mandrel and including one or more coil windings wrapped about the tool mandrel;

an antenna shield about the antenna, the antenna shield including at least two pieces;

a fastener for removably coupling the antenna shield to the tool mandrel; and a constraining element to limit rotational motion of the antenna shield about the tool mandrel to limit torsional forces on the fastener, the constraining element disposed in a through hole defined in the antenna shield and a cavity defined in the tool mandrel, and the antenna shield and the tool mandrel being coupled to each other via an interference fit between the constraining element and the through hole and the cavity; and obtaining measurements of a surrounding subterranean formation with the logging tool.

7. The method of claim 6, wherein the tool mandrel is operatively coupled to a drill string and introducing the logging tool into the wellbore further comprises:

extending the logging tool into the wellbore on the drill string; and drilling a portion of the wellbore with a drill bit secured to a distal end of the drill string.

8. The method of claim 6, wherein introducing the logging tool into the wellbore further comprises extending the logging tool into the wellbore on wireline as part of a wireline instrument sonde.

9. The method of claim 6, wherein the constraining element includes a dowel pin.

10. The method of claim 6, wherein the logging tool further includes a plurality of circumferentially spaced and axially elongated slots defined in the antenna shield, wherein the slots are substantially parallel with a longitudinal axis of the logging tool and the antenna is exposed through the slots.

* * * * *